US010399737B2

(12) United States Patent
Chen

(10) Patent No.: US 10,399,737 B2
(45) Date of Patent: Sep. 3, 2019

(54) ASSEMBLED BASKET

(71) Applicant: SUII HOME CO., LTD., Taichung (TW)

(72) Inventor: Yi-Yu Chen, Taichung (TW)

(73) Assignee: SUII Home Co., Ltd., Taichung (TW)

( * ) Notice: Subject to any disclaimer, the term of this patent is extended or adjusted under 35 U.S.C. 154(b) by 87 days.

(21) Appl. No.: 15/709,861

(22) Filed: Sep. 20, 2017

(65) Prior Publication Data

US 2019/0084718 A1 Mar. 21, 2019

(51) Int. Cl.
*B65D 6/24* (2006.01)
*A47B 47/00* (2006.01)

(52) U.S. Cl.
CPC ..... *B65D 11/1873* (2013.01); *A47B 47/0083* (2013.01); *A47B 2230/0077* (2013.01)

(58) Field of Classification Search
CPC ..... B65D 11/00; B65D 11/18; B65D 11/1866; B65D 11/1873; A47B 47/00; A47B 47/0083; A47B 2230/0077
USPC ..... 220/4.33, 4.08, 4.16, 4.28, 9.1–9.3, 220/485–495
See application file for complete search history.

(56) References Cited

U.S. PATENT DOCUMENTS 5,101,995 A * 4/1992 Trubiano ..... B65D 7/30 220/1.5
5,282,542 A * 2/1994 Mo ..... B65D 7/26 220/485
5,931,326 A * 8/1999 Weng ..... B65D 7/24 220/4.28
6,230,915 B1 * 5/2001 Liu ..... B65D 9/12 217/122
6,401,950 B1 * 6/2002 Chiang ..... B62B 3/005 220/1.5
6,601,723 B1 * 8/2003 Ziglar ..... A47B 43/00 220/4.28
6,712,436 B2 * 3/2004 Chen ..... F16B 12/26 220/4.28
6,726,045 B1 * 4/2004 Chen ..... A47B 47/0075 220/4.33
7,481,182 B2 * 1/2009 Simpson ..... A01K 1/0125 119/168
7,823,738 B2 * 11/2010 Wang ..... B65D 9/12 217/12 R (Continued)

*Primary Examiner* — Kareen K Thomas
(74) *Attorney, Agent, or Firm* — Muncy, Geissler, Olds & Lowe, P.C.

(57) ABSTRACT

An assembled basket includes four plate members, four securing and engaging columns and a lower plate. Each plate member includes a body, and a first assembly element and a second assembly element oppositely disposed at two sides of the body. Each first assembly element has a first inclined surface and a first groove. Each second assembly element has a second inclined surface corresponding to the first inclined surface and a second groove in communication with the first groove. Each securing and engaging column includes a first column body, a second column body, and a connecting element connecting the first column body and the second column body. The four securing and engaging columns are correspondingly fastened at the four first grooves and the four first second grooves to form a cubic structure. The lower plate is disposed at a lower side of the four plate members.

7 Claims, 6 Drawing Sheets

(56) References Cited

U.S. PATENT DOCUMENTS

| | | | | |
|---|---|---|---|---|
| 8,985,374 | B2 * | 3/2015 | Tsai | B65D 7/20 220/4.28 |
| 2007/0034584 | A1 | 2/2007 | Park | |
| 2011/0220544 | A1 * | 9/2011 | De Alba | B65D 19/385 206/600 |
| 2015/0053688 | A1 * | 2/2015 | Peters | B62B 3/027 220/492 |

* cited by examiner

ASSEMBLED BASKET

FIELD OF THE INVENTION

The present invention relates to a basket, and particularly to an assembled basket.

BACKGROUND OF THE INVENTION

To effectively utilize living space, many shelves and cabinets are usually designed in an indoor space to facilitate storage of various objects. Conventional system cabinets, requiring planning, design and construction processes, are more costly and do not offer renovation flexibilities. In response, products such as assembled cabinets and assembled baskets are developed, and have gradually become a market mainstream.

For example, the U.S. Patent Publication No. 20070034584, "Assembling type sectional shelf structure", includes: a plurality of rectangular prism shaped shelves; assembling members which are assembled at the corner portions of the opposite sides of the shelves and have triangle shaped through holes at inner sides; fixing members which have support member holes at center portions, guide ribs formed at both sides of the inner walls, and engaging protrusions formed at side surfaces and are inserted into the through holes of the assembling members; and support members which include guide grooves which are engaged with the guide ribs, with engaging grooves engaged with the engaging protrusions of the fixing members being formed at one side surface of the support members.

However, such assembled cabinet yields lower overall esthetic values and easily gives people a sense of being cheap. Therefore, there is a need for solution that enhances the overall esthetic values of an assembled cabinet.

SUMMARY OF THE INVENTION

It is an object of the present invention to solve the issue of low esthetic values of products such as assembled cabinets and assembled baskets.

To achieve the above object, the present invention provides an assembled basket including four plate members, four securing and engaging columns, and a lower plate. The four plate members are adjacent to one another in an encircling manner to form a rectangle. Each of the four plate members includes a body, and a first assembly element and a second assembly element. Each of the four first assembly elements includes a first inclined surface and a first groove. The first groove has a first opening located at the inclined surface, a first positioning recess, and a first limiting portion in communication with the first positioning recess and the first opening. An inner diameter of the first positioning recess is greater than an inner diameter of the first limiting portion. Each of the four second assembly elements has a second inclined surface corresponding to the first inclined surface and a second groove. The second groove includes a second opening located at the second inclined surface and correspondingly in communication with the first opening, a second positioning recess, and a second limiting portion in communication with the second positioning recess and the second opening. An inner diameter of the second positioning recess is greater than an inner diameter of the second limiting portion. The four securing and engaging columns join the four plate members. Each of the four securing and engaging columns includes a first column body, a second column body, and a connecting element connecting the first column body and the second column body. The four first column bodies are correspondingly fastened at the four first positioning recesses, respectively, the four second column bodies are correspondingly fastened at the second positioning recesses, respectively, and the four connecting elements are correspondingly fastened at the four first limiting portions and the four second limiting portions, respectively, forming a cubic structure. The lower plate is disposed at a lower side of the four plate members.

In conclusion, by using the first assembly elements and the second assembly elements, the present invention keeps the securing and engaging columns concealed, thus enhancing the overall esthetic values.

DETAILED DESCRIPTION OF THE PREFERRED EMBODIMENTS

Figure 1:
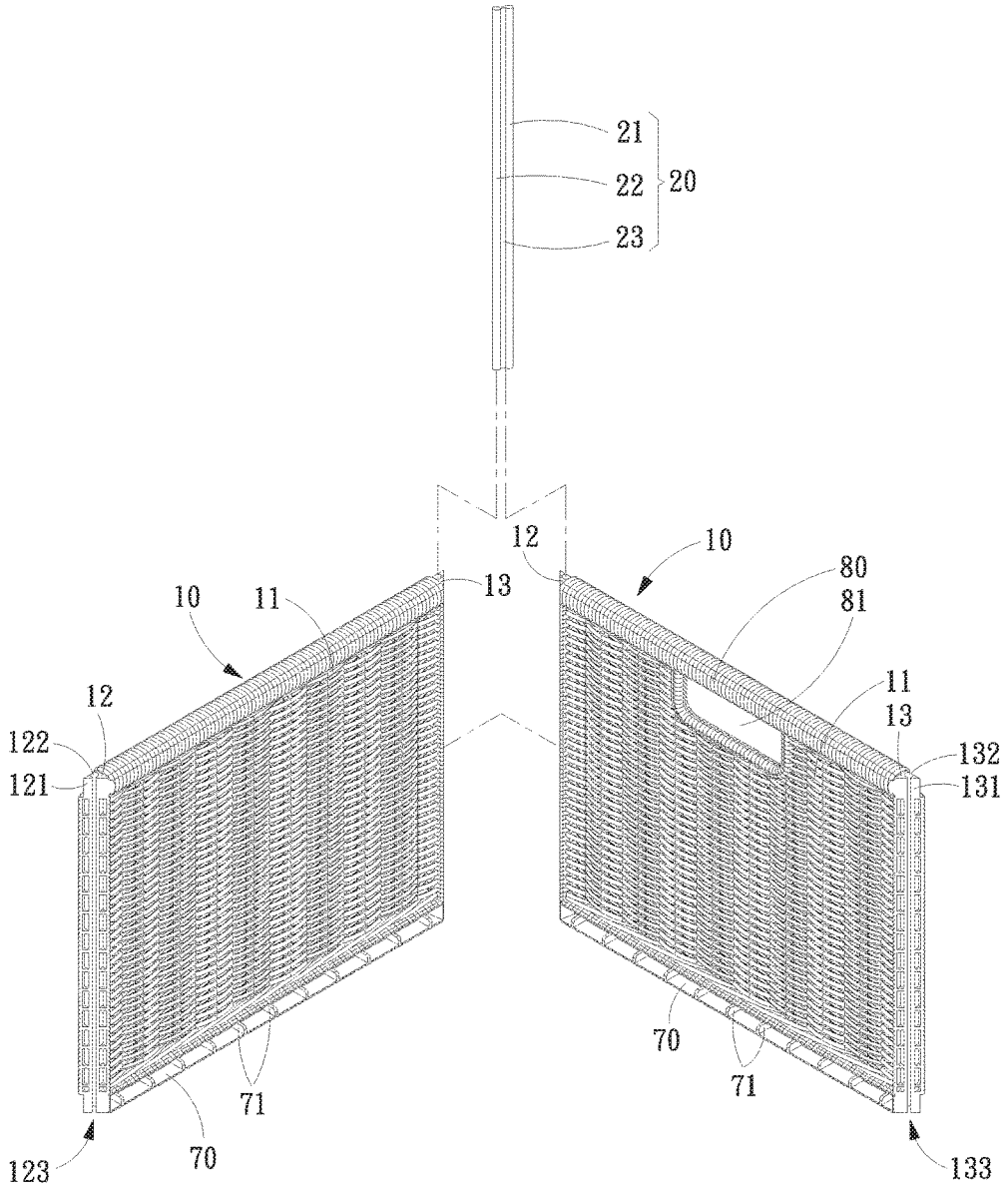
FIG. 1 is a first partial exploded schematic diagram according to an embodiment of the present invention.
Figure 2A:
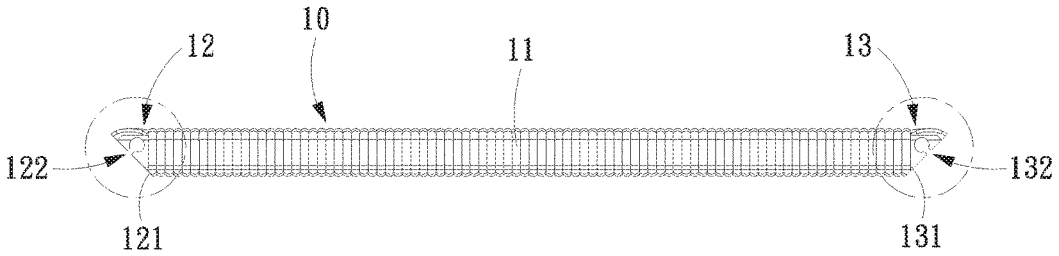
FIG. 2A is a partial top schematic diagram according to an embodiment of the present invention.
Figure 2B:
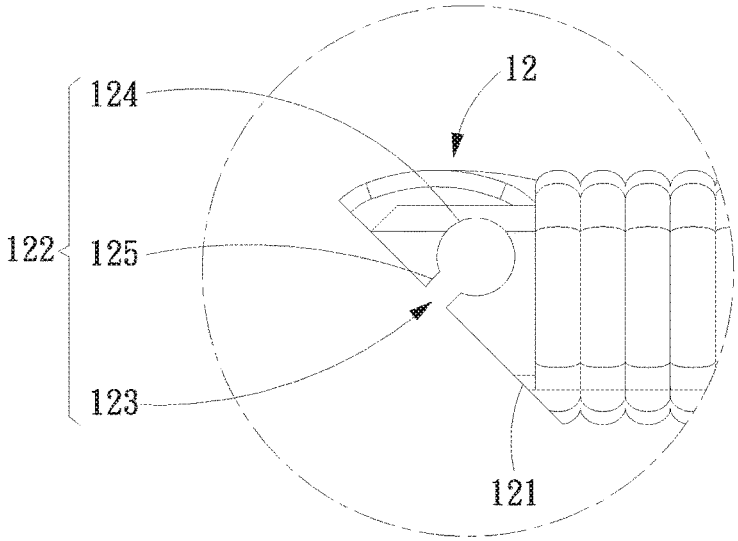
FIG. 2B is a first enlarged partial schematic diagram according to an embodiment of the present invention.
Figure 2C:
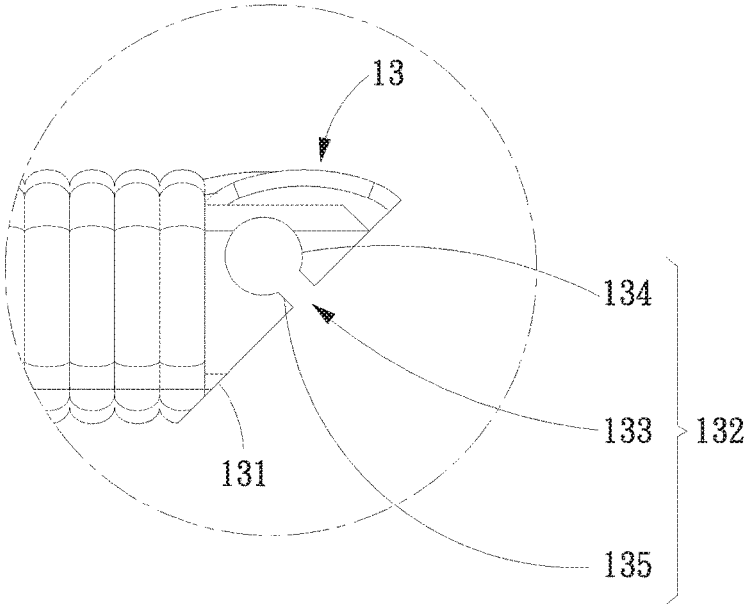
FIG. 2C is a second enlarged partial schematic diagram according to an embodiment of the present invention.
Figure 3:
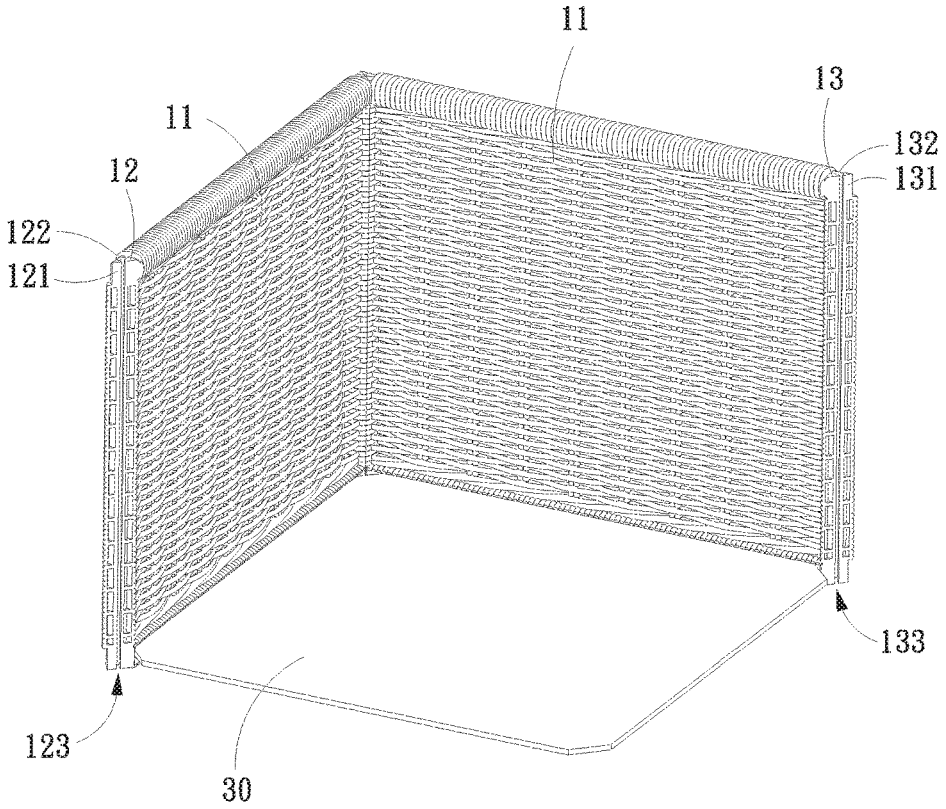
FIG. 3 is a partial assembly schematic diagram according to an embodiment of the present invention.

Details and technical contents of the present invention are given with the accompanying drawings below.

Referring to FIG. 1, FIG. 2, FIG. 3 and FIG. 4, the present invention provides an assembled basket including four plate members 10, four securing and engaging columns 20 and a lower plate 30. Each of the four plate members 10 includes a body 11, a first assembly element 12 and a second assembly element 13. The first assembly element 12 and the second assembly element 13 are oppositely disposed at two sides of the body 11. Each of the four first assembly elements 12 has a first inclined surface 121 and a first groove 122. The first groove 122 includes a first opening 123 located at the first inclined surface 121, a first positioning recess 124, and a first limiting portion 125 in communication with the first positioning recess 124 and the first opening 123. An inner diameter of the first positioning recess 124 is greater than an inner diameter of the first limiting portion 125. Each of the four second assembly elements 13 has a second inclined surface 131 corresponding to the first inclined surface 121 and a second groove 132. The second groove 132 includes a second opening 133 located at the second inclined surface 131 and correspondingly in communication with the first opening 123, a second positioning recess 134, and a second limiting portion 135 in communication with the second positioning recess 134 and the second opening 133. An inner diameter of the second positioning recess 134 is greater than an inner diameter of the second limiting portion 135.

Figure 4:
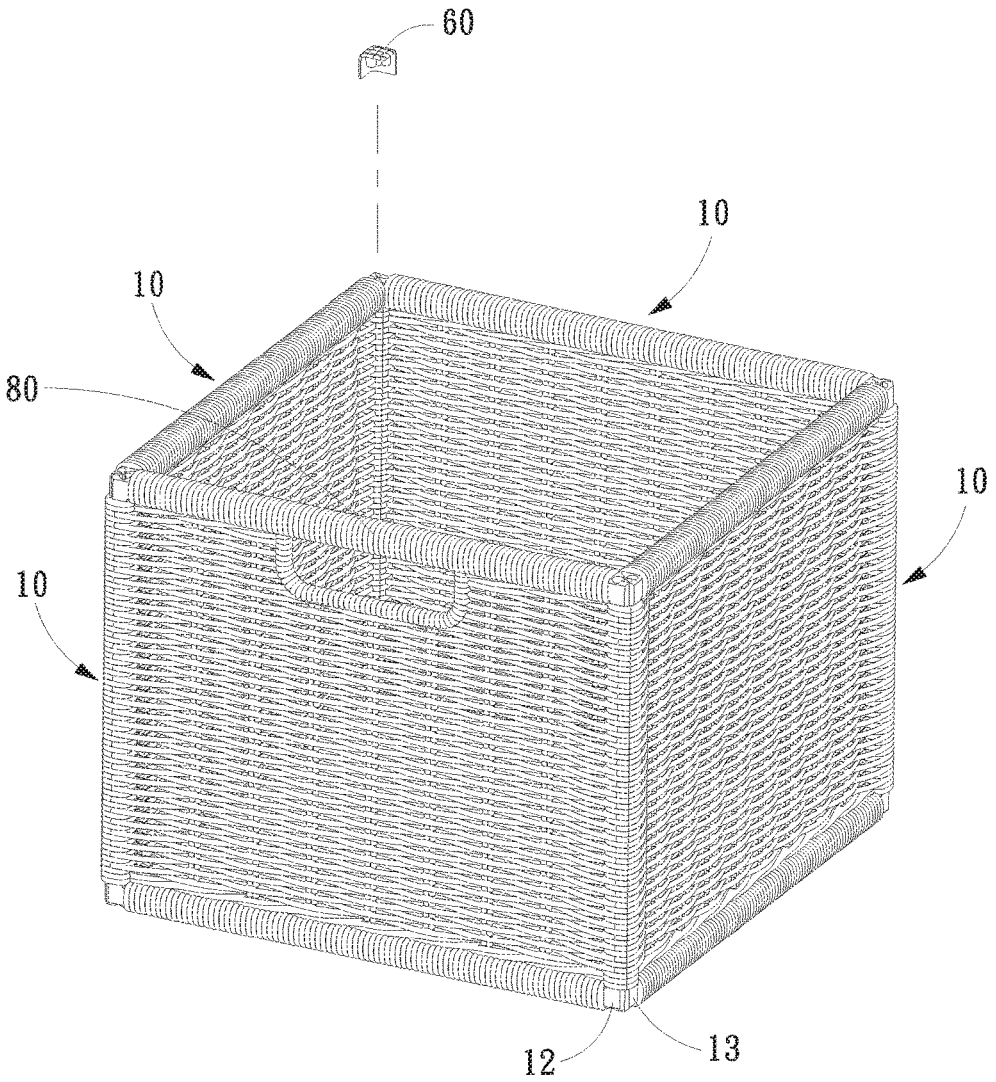
FIG. 4 is a second partial exploded schematic diagram according to an embodiment of the present invention.

The four securing and engaging columns 20 are for joining the four plate members 10. Each of the four securing and engaging columns 20 includes a first column body 21, a second column body 22, and a connecting element 23 connecting the first column body 21 and the second column body 22. The four first column bodies 21 are correspondingly fastened at the four first positioning recesses 124, respectively. The four second column bodies 22 are correspondingly fastened at the four second positioning recesses 134, respectively. The four connecting elements 23 are correspondingly fastened at the four first limiting portions 125 and the second limiting portions 135, respectively. Thus, when the four securing and engaging columns 20 are correspondingly fastened at the four first positioning recesses 124, the four second positioning recesses 134, the four first limiting portions 125 and the four second limiting portions 135, a cubic structure is formed, as shown in FIG. 4. The lower plate 30 is disposed at a lower side of the four plate members 10, and seals the opening of the lower side to form a cabinet body with the above cubic structure. As such, the four securing and engaging columns 20 are concealed in the first assembly elements 12 and the second assembly elements 13, in a way that traces for assembly cannot be perceived to enhance the overall esthetic values.

In this embodiment, the first positioning recess 124 and the second positioning recess 134 are shaped as cylindrical grooves, and the first column body 21 and the second column body 22 are shaped as cylindrical bodies corresponding to first positioning recess 124 and the second positioning recess 134. The first limiting portion 125 and the second limiting portion 135, after communicating with the first opening 123 and the second opening 133, appear as rectangular grooves. The connecting element 23 is shaped as a rectangular column corresponding to the first limiting portion 125 and the second limiting portion 135, allowing the four securing and engaging columns 20 to be perfectly joined with the first assembly elements 12 and the second assembly elements 13.

Each of the four plate members 10 further includes a fastening groove 70 disposed at a lower portion thereof. The lower plate 30 is fastened at the four fastening grooves 70 and is thus secured. To further prevent the lower plate 30 from sliding, each of the four fastening grooves 70 further includes a plurality of securing portions 71 for positioning and fastening the lower plates 30. In this embodiment, any one of four plate members 10 includes a handle portion 80. The plate member 10 having the handle portion 80 among the four plate members 10 has a through hole 81, which is adjacent to an edge of the plate member 10 to form the handle portion 80, so as to increase convenience for holding and withdrawing operations.

Figure 5:
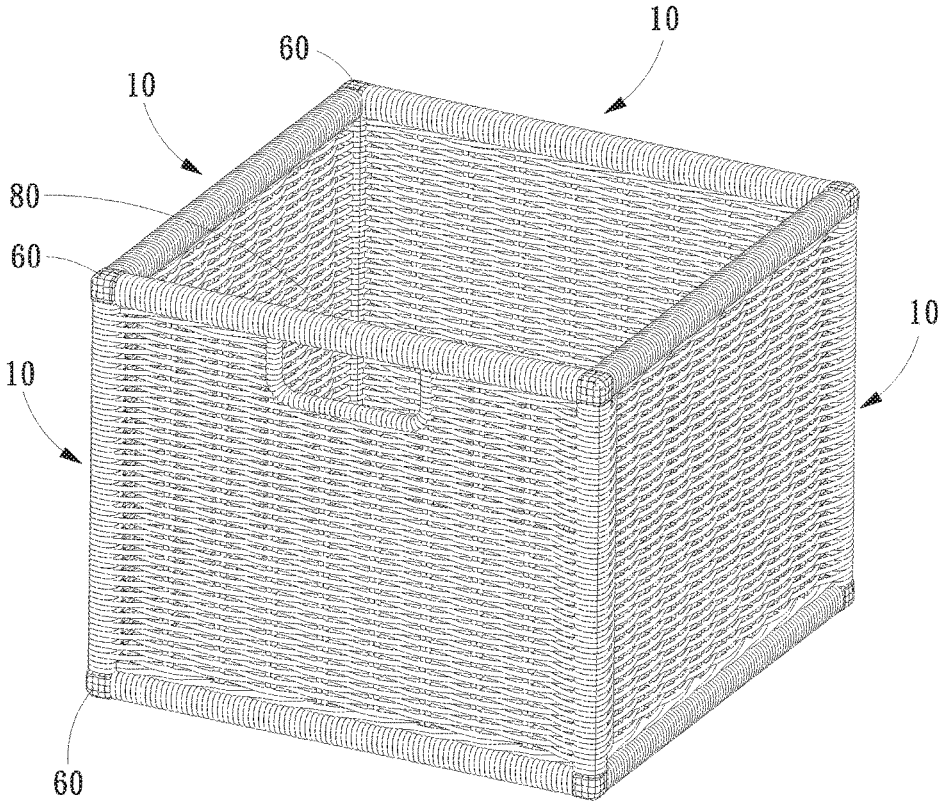
FIG. 5 is a perspective structural schematic diagram according to an embodiment of the present invention.

Referring to FIG. 4 and FIG. 5, to further enhance esthetic values, eight auxiliary securing elements 60 may be further disposed at two opposite ends of the four first assembly elements 12 and the four second assembly elements 13, respectively. A surface pattern of the eight auxiliary securing elements 60 may correspond to a surface pattern of the four plate members 10 to provide consistency, thus enhancing the overall esthetic values.

In conclusion, the present invention provides following advantages.

1. By concealing the four securing and engaging columns in the four first assembly elements and the four second assembly elements, assembly traces cannot be perceived to enhance the overall esthetic values.

2. The lower plate is prevented from sliding by the four fastening grooves and the securing portions.

3. The surface patterns of the auxiliary securing elements provided and the plate members are consistent to enhance the overall esthetic values.

4. The handle portion provided increases the convenience for holding and withdrawing operations.

What is claimed is:

1. An assembled basket, comprising:

four adjacent plate members in a complete surrounding manner and forming a rectangle; each of the four plate members comprising a body, and a first assembly element and a second assembly element oppositely disposed at two sides of the body; each of the four first assembly elements having a first inclined surface and a first groove; the first groove comprising a first opening located at the first inclined surface, a first positioning recess, and a first limiting portion in communication with the first positioning recess and the first opening; an inner diameter of the first positioning recess being greater than an inner diameter of the first limiting portion; each of the four second assembly elements having a second inclined surface corresponding to the first inclined surface and a second groove; the second groove comprising a second opening located at the second inclined surface and correspondingly in communication with the first opening, a second positioning recess, and a second limiting portion in communication with the second positioning recess and the second opening; an inner diameter of the second positioning recess being greater than an inner diameter of the second limiting portion;

four securing and engaging columns joining the four plate members, each of the four securing and engaging columns comprising a first column body, a second column body, and a connecting element connecting the first column body and the second column body; the four first column bodies correspondingly fastened at the four first positioning recesses, respectively, the four second column bodies correspondingly fastened at the four second positioning recesses, respectively, the four connecting elements correspondingly fastened at the four first limiting portions and the four second limiting portions, respectively, forming a cubic structure; and a lower plate, disposed at a lower side of the four plate members.

2. The assembled basket of claim 1, further comprising eight auxiliary securing elements, and the eight auxiliary securing elements are disposed at two opposite ends of the four first assembly elements and the four second assembly elements, respectively.

3. The assembled basket of claim 1, wherein each of the four plate members further comprises a fastening groove at a lower portion thereof, and the lower plate is fastened at the four fastening grooves.

4. The assembled basket of claim 3, wherein each of the four fastening grooves comprises a plurality of securing portions for fastening the lower plate.

5. The assembled basket of claim 1, wherein the first positioning recesses and the second positioning recesses are shaped as cylindrical grooves, the first limiting portions and the second limiting portions in communication are shaped as rectangular grooves, the first column bodies and the second column bodies are shaped as cylindrical bodies corresponding to the first positioning recesses and the second positioning recesses, and the connecting elements are shaped as rectangular columns corresponding to the first limiting portions and the second limiting portions.

6. The assembled basket of claim 1, wherein any one of the four plate members comprises a handle portion.

7. The assembled basket of claim 6, wherein the plate member comprising the handle portion has a through hole, and the through hole is adjacent to an edge of the plate member to form the handle portion.

* * * * *